US006202660B1

(12) United States Patent
Steiner

(10) Patent No.: US 6,202,660 B1
(45) Date of Patent: Mar. 20, 2001

(54) UPRIGHT SHADE

(76) Inventor: Walter Steiner, Santisstrasse 52, CH-8311 Brutten (CH)

( * ) Notice: Subject to any disclaimer, the term of this patent is extended or adjusted under 35 U.S.C. 154(b) by 0 days.

(21) Appl. No.: 09/423,496

(22) PCT Filed: Mar. 3, 1999

(86) PCT No.: PCT/CH99/00101

§ 371 Date: Dec. 13, 1999

§ 102(e) Date: Dec. 13, 1999

(87) PCT Pub. No.: WO99/44459

PCT Pub. Date: Sep. 10, 1999

(30) Foreign Application Priority Data

Mar. 7, 1998 (CH) ..... 0549/98

(51) Int. Cl.[7] ..... A45B 25/14; A45B 23/00
(52) U.S. Cl. ..... 135/22; 135/98
(58) Field of Search ..... 135/20.3, 22, 98

(56) References Cited

U.S. PATENT DOCUMENTS

| | | | | |
|---|---|---|---|---|
| 2,705,967 | * | 4/1955 | Zimmermann et al. | 135/22 |
| 2,906,277 | * | 9/1959 | Militano | 135/22 |
| 3,008,478 | * | 11/1961 | Foltis et al. | 135/22 |
| 3,073,327 | * | 1/1963 | Foltis et al. | 135/22 |
| 4,747,422 | * | 5/1988 | Chung | 135/20.3 |
| 4,823,821 | * | 4/1989 | Day | 135/22 |
| 4,928,718 | | 5/1990 | Apple | 135/22 |
| 5,483,985 | * | 1/1996 | Yu | 135/22 |

FOREIGN PATENT DOCUMENTS

| | | | | |
|---|---|---|---|---|
| 187643 | * | 1/1956 | (DE) | 135/22 |
| 2236149 | * | 2/1974 | (DE) | 135/20.3 |
| 195 19 034 | | 5/1996 | (DE) . | |
| 0200571 | | 11/1986 | (EP) . | |
| 0392989 | | 10/1990 | (EP) . | |
| 2238448 | | 2/1974 | (FR) . | |
| 1167472 | * | 10/1969 | (GB) | 135/22 |
| 9215218 | | 9/1992 | (WO) . | |

* cited by examiner

*Primary Examiner*—Robert Canfield
(74) *Attorney, Agent, or Firm*—Edwin D. Schindler

(57) ABSTRACT

The upright shade consists of an upright tube (1) and a shade structure made up of roof struts (7) which are joined to a mobile end crown (4) disposed at the top end of a push tube (3). Push tube (3) can be longitudinally displaced inside upright tube (1). Supporting struts (6) are provided, which are connected at their top ends to roof struts (7) in order to provide support, and at their bottom ends to a runner crown (5) which can be displaced along upright tube (1). Auxiliary struts (8) are also provided to coordinate the opening and closing movements of the roof struts (7) and supporting struts (6). Said auxiliary struts are articulated, and are arranged between a stationary crown (2) disposed at the top end of the upright tube, and the supporting struts (6). A steel or pneumatic spring is fitted inside upright tube (1) for partially automatic opening and closing of the shade. This allows end crown (4) to be moved in a partially automatic manner—i.e. with little expenditure of effort, simply by displacing one roof strut (7)—into its lowest position, thereby opening the shade, or into its uppermost position, thereby closing the shade.

5 Claims, 4 Drawing Sheets

UPRIGHT SHADE

BACKGROUND OF THE INVENTION

1. Technical Field of the Invention

Figure 1:
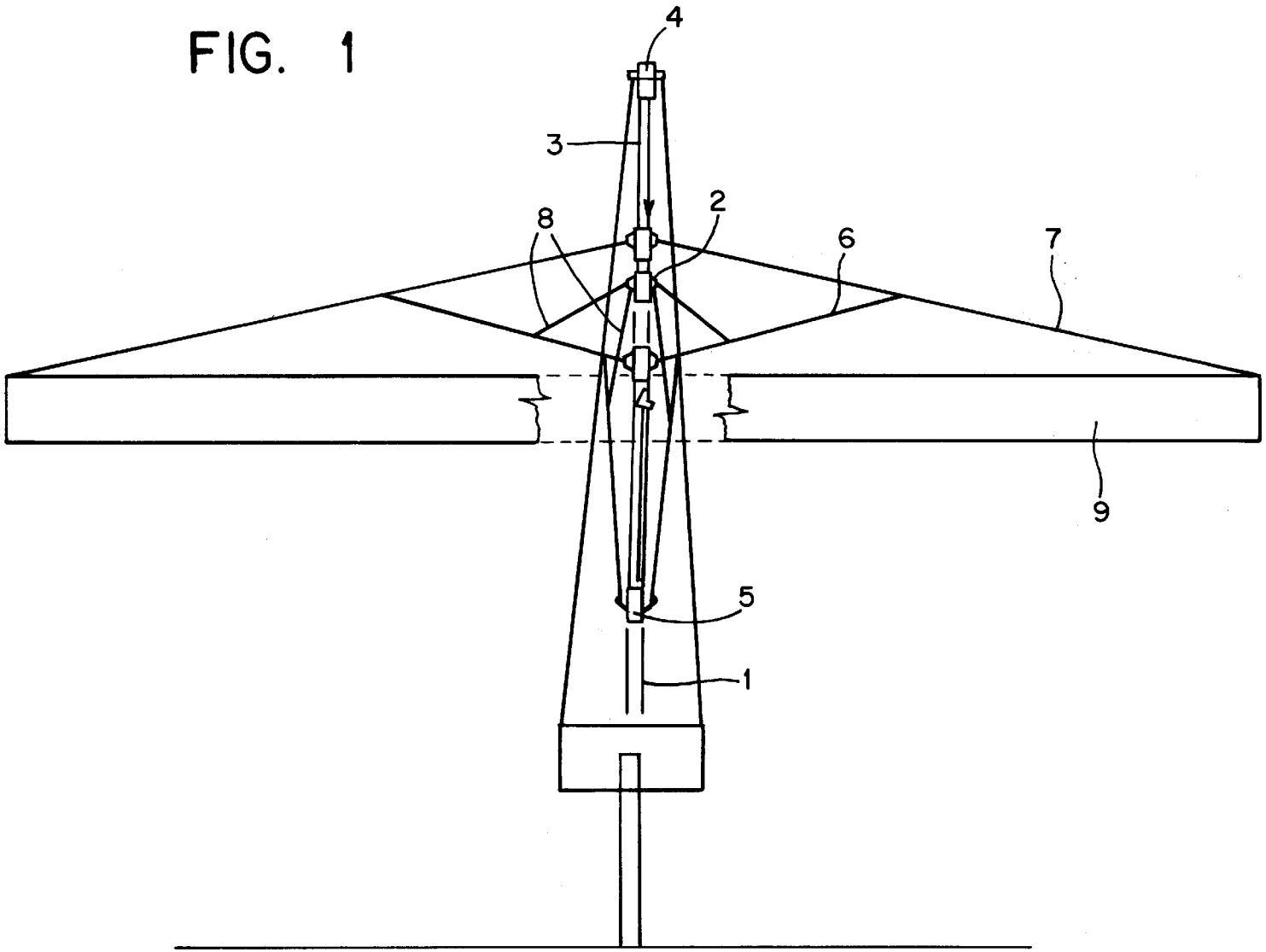

This invention relates to an upright shade for use as a sunshade, garden shade or market stand shade etc.. The stand has a central upright tube with a shade structure and cloth as the roof awning, which is stretched out over the roof struts when the shade is opened.

2. Description of the Prior Art66

Prior art garden, sun and market stand shades already exist in a variety of embodiments. One especially highly developed shade is disclosed in PCT/DE92/00155. It comprises three crowns, namely an end crown, which forms the tip of the shade, and moves upwards when the shade is shut, a vertically fixed crown, which is securely mounted on the upright tube and serves to coordinate the closing and opening movements of the shade structure, and a runner crown to which the shade struts are joined, and which can move up and down the upright tube. Disposed between the roof struts and the fixed crown there are further auxiliary struts which are also designed to play a coordinating role as the shade opens and closes. During the opening movement, the two mobile crowns move towards each other, i.e. the end crown moves downwards, and the runner crown upwards, whilst the roof struts are simultaneously forced outwards, thereby opening the shade awning. Conversely, when the shade is closed, the end crown moves upwards and the runner crown downwards, and the roof struts are swung downwards. This mechanical arrangement offers kinetic advantages, because the opened shade is not opened so high above the ground as it would be if its end crown were mounted in a stationary fashion at the end of an upright tube. The construction reaches the limits of feasibility, however, when it has to be used for especially large shades, or when easy of operation is a priority. With large shades, the effort required to operate them is too great. There is a growing demand for large shades, however, and users also want them to be easy to operate, i.e. with little expenditure of effort.

SUMMARY OF THE INVENTION

Hence the task of this invention is to provide an upright shade of this type which can be opened and closed with little expenditure of effort.

This task is solved by an upright shade with an upright tube, a shade structure made up of roof struts which are joined to a mobile end crown disposed at the top end of push tube which can be longitudinally displaced inside the upright tube; there are also supporting struts which are joined at their top ends to the roof struts in order to provide support, and at their bottom ends to a runner crown which can be displaced along the upright tube, as well as auxiliary struts to coordinate the opening and closing movement of the roof struts and supporting struts, said auxiliary struts being articulated, and arranged between a stationary crown disposed at the top end of the upright tube and the supporting struts, with this upright shade being characterized in that a steel or pneumatic spring is fitted inside the upright tube for partially automatic opening and closing of the shade in that the end crown can be moved partially automatically—i.e. with little expenditure of effort, by displacing one roof strut—into its lowest position, thereby opening the shade, or into its uppermost position, thereby closing the shade.

BRIEF DESCRIPTION OF THE DRAWING FIGURES

Figure 2:
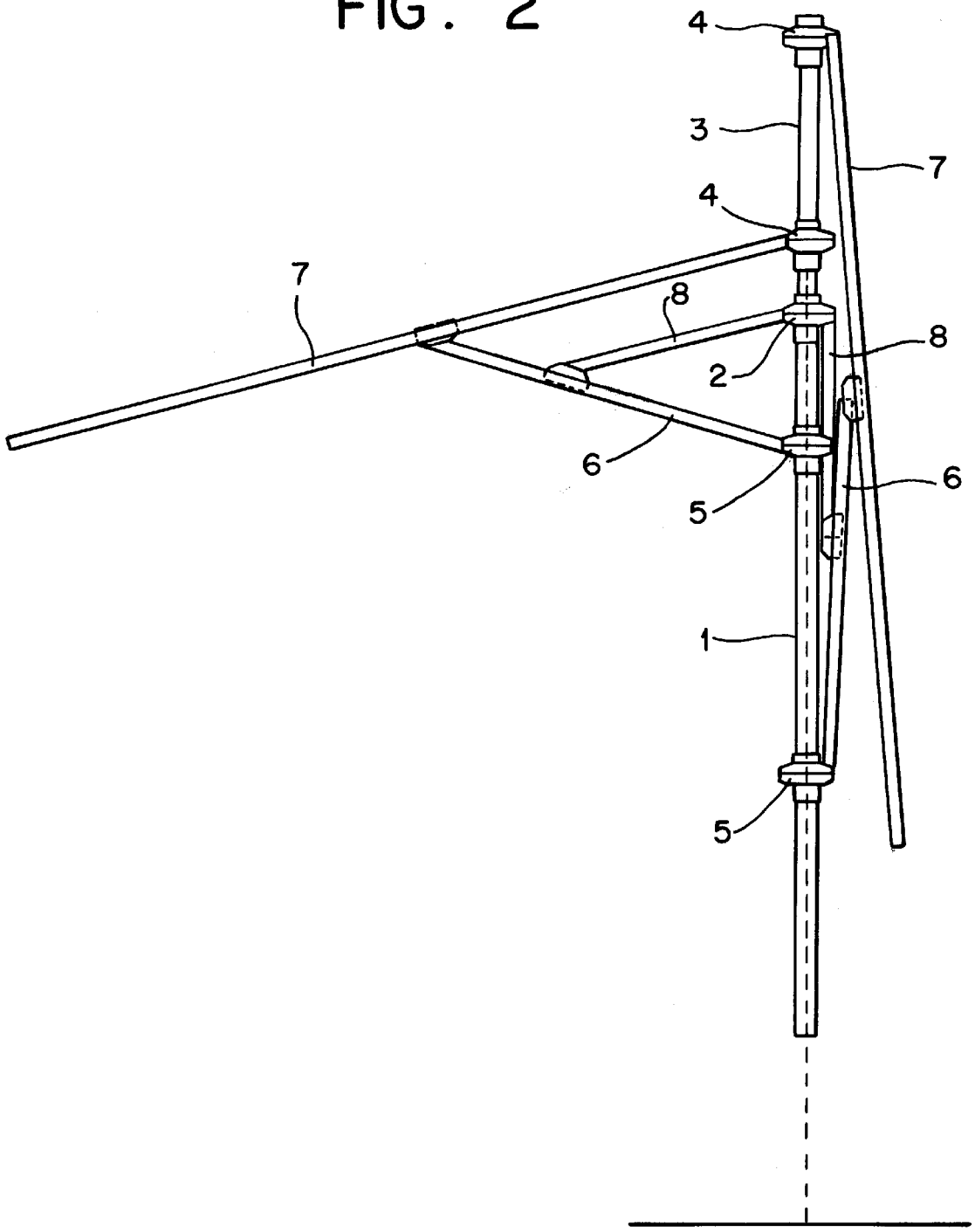
Figure 3:
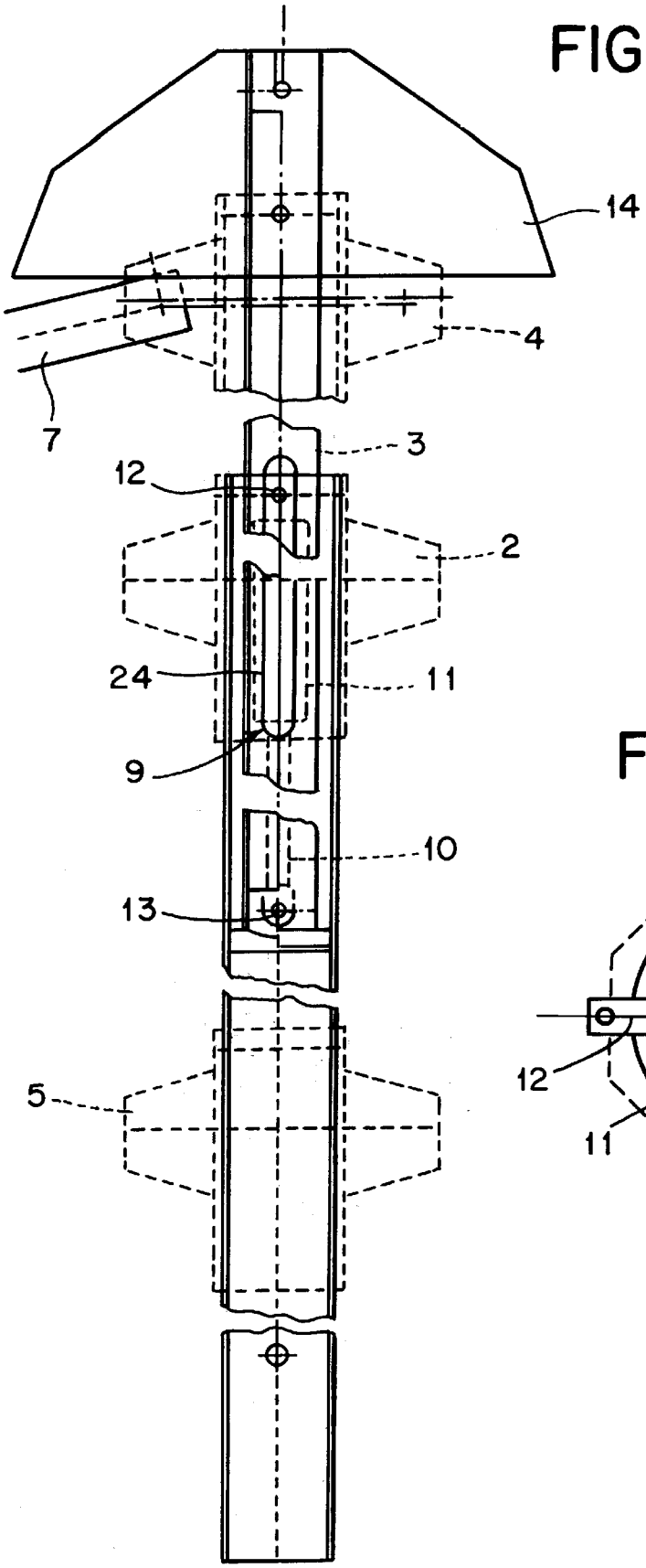
Figure 4:
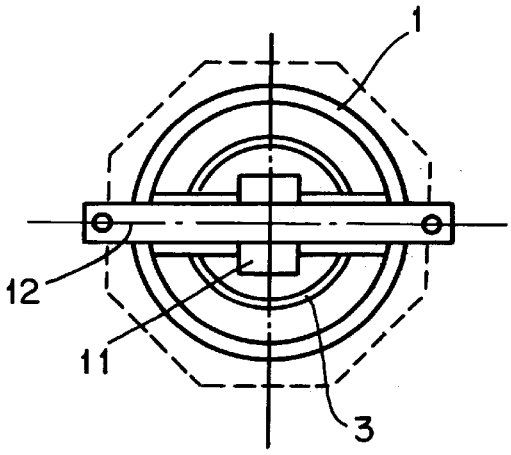
Figure 5:
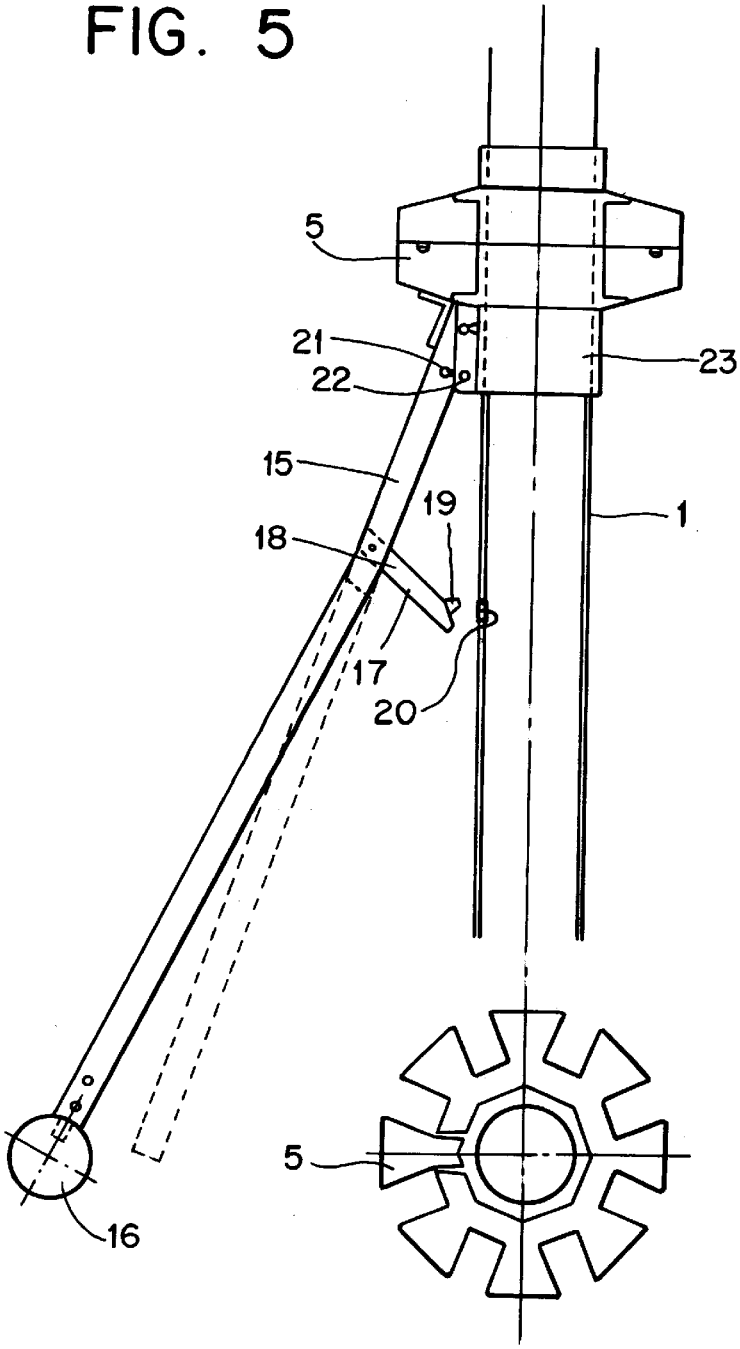
Figure 6:
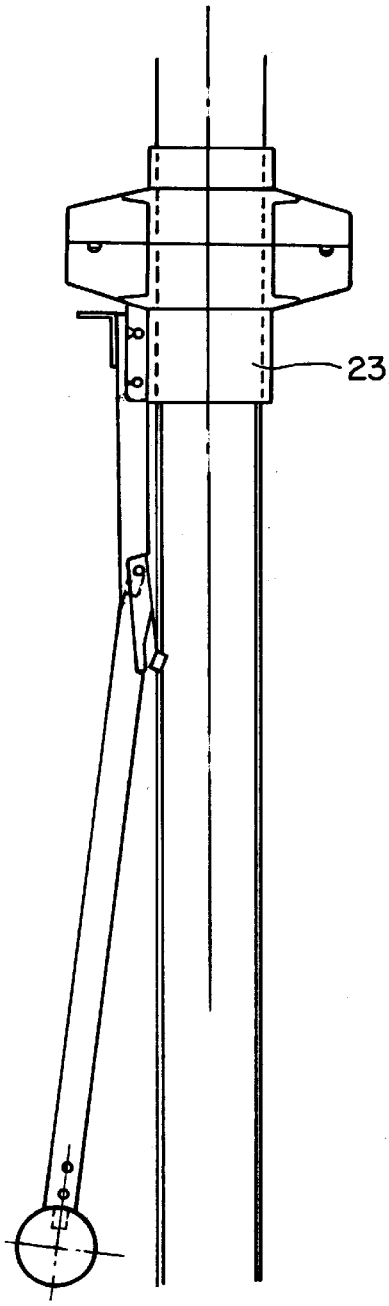

Examples of embodiments of this upright shade are shown in the drawings. The upright shade will be described below, and its mode of functioning explained with reference to these drawings, in which:

FIG. 1: shows the shade with shade structure and shade awning seen from the side, in its opened and closed positions;

FIG. 2: shows the shade structure seen from the side, with the shade in its open position on the left side of the upright tube, and in its closed position on the right side of the upright tube;

FIG. 3: shows one possible way of fitting the pneumatic spring inside the upright tube together with the push tube in an enlarged section;

FIG. 4: shows a cross-section of the upright tube at the height of the bolt which passes through both the upright tube and the pneumatic spring;

FIG. 5: shows the articulated lever for opening out the shade awning in its released position;

FIG. 6: shows the articulated lever for opening out the shade awning in its tensioned position.

DETAILED DESCRIPTION OF THE DRAWINGS AND PREFERRED EMBODIMENTS

FIG. 1 shows the shade seen from the side, in both the closed and opened positions. It consists of an upright tube 1, with a stationary crown 2 at its top end.

Inside upright tube 1 there is a push tube 3, which can be displaced inside upright tube 1 and is topped by an end crown 4. Disposed on upright tube 1, below stationary crown 2, there is a runner crown 5, which supports the supporting struts 6 for the roof struts 7 of the shade in that said supporting struts are joined to this runner crown 5. When the shade is opened, runner crown 5 moves up whilst the end crown 4 to which roof struts 7 are joined moves down at the same time. This counter-movement results from the geometry of the shade structure, in that auxiliary struts 8 are disposed between stationary crown 2 and supporting struts 6. Roof struts 7 support shade awning 25.

FIG. 2 shows the shade structure of this upright shade in more detail. It consists of the upright tube 1, into which a push tube 3 is inserted from the top and can be moved up and down inside upright tube 1. Attached to the top end of upright tube 1 there is a stationary crown 2, to which auxiliary struts 8 are joined. At the top end of push tube 3 there is an end crown 4, to which roof struts 7 are joined. The supporting struts 6 for supporting roof struts 7 are connected to a runner crown 5, which can be moved up and down upright tube 1. To open and erect the shade, end crown 4 has to be moved downwards, or runner crown 5 has to be moved upwards. Given that supporting struts 6 are connected to fixed crown 2 via auxiliary struts 8, the displacement of mobile crowns 4,5 forces the movement of roof struts 7 in a certain manner, namely in that they are spread outwards when the shade is opened, and made to fold down when the shade is closed. As a result of the geometry of this arrangement of roof struts 7, supporting struts 6 and auxiliary struts 8, it is sufficient merely to move e.g. the end crown 4 downwards and the geometry will ensure a coordinated movement of the other parts, so that roof struts 7 open outwards and runner crown 5 moves upwards. The shade can be closed in the same manner, i.e. simply by extending the push tube 3, and end crown 4 with it. The geometry of struts 6,7,8 causes the shade to close, resp. roof struts 7 to fold down. With a small shade, the force can be supplied e.g. by pulling end crown 4 downwards by means of a cord, whereupon the shade will open, or one can grip the end of a single roof strut 7 and swing it outwards and upwards, whereupon end crown 4 moves downwards and runner crown 5 moves upwards simultaneously. By way of a third variant, runner crown 5 can also be moved upwards. This causes roof struts 7 to open outwards and end crown 4 moves downwards.

As a general rule, upright shades of this type are manufactured with diameters of 3.8 m, 4.4 m, 5 m, 5.6 m and bigger, adding 60 cm to the diameter each time. Upright shades with an open shade diameter of e.g. 3.8 m and more are difficult to open and close manually. It is for this reason that the upright shade presented here has a steel or pneumatic spring for a partially or semi-automatic opening and closing.

This partially automatic upright shade functions with a mechanical spring or a pneumatic spring. The force of the spring actively draws top end crown 4 downwards towards upright tube 1, and as a consequence runner crown 5 moves up along upright tube 1 and roof struts 7 open outwards. To achieve this, a gas pressure spring 9, for example, is fitted inside upright tube 1, as shown in FIG. 3. In this drawing, gas pressure spring 9 is disposed with its cylinder 11 upwards and its piston rod 10 extends downwards and is connected at its end with push tube 3. In detail, gas pressure cylinder 11 is secured to upright tube 1 by means of a bolt 12. At the bottom end of piston rod 10 there is another bolt 13 for securely connecting piston rod 10 to push tube 3.

The small FIG. 4 adjacent to FIG. 3 depicts a cross-section showing how this bolt 12 passes through upright tube 1, runs through the slit in push tube 3, and holds gas pressure cylinder 11 in place so that the latter is securely connected to upright tube 1.

When piston rod 10 moves in and out, push tube 3 moves inside upright tube 1. This is why push tube 3 has a slit 24 to enable it to travel past stationary bolt 12 over the length of this slit 24. When pneumatic spring 9 is compressed, therefore, piston rod 10 is retracted and the shade is closed. End crown 4 is in its topmost position. In the drawing shown here, the end crown is covered over with a cover cap 14. When piston rod 10 is extended, the situation shown in FIG. 3 occurs. Slit 24 has travelled down past bolt 12, virtually right to its end. The end of piston rod 10 has pulled push tube 3 down with it, and hence end crown 4 as well. The roof struts 7 joined to end crown 4 are therefore opened outwards, as indicated, and the shade is thus erected. At the bottom of upright tube 1, the geometry of the struts already described above has caused runner crown 5 to move upwards, together with the supporting struts joined to it, and it has reached its uppermost position. This entire sequence of movement to open the shade takes place almost by itself. All one has to do is grip the end of one roof strut and then pull this roof strut outwards with one finger, so to speak, and swing it slightly upwards, whereupon the shade will open alone. The entire opening or erection of the shade therefore proceeds on a partially automatic basis, with a perfectly acceptable level of physical work resp. effort. Conversely, the forces that take effect because of the geometry and the force of the chosen gas pressure spring are dosed so that the shade can also be closed with very little effort. Again, one grips the end of a roof strut and folds it down. This goes against the acting force of the gas pressure spring, but only requires very little effort because of the geometry. One can, of course, achieve exactly the same effect by fitting the gas pressure spring the other way round, so that the piston rod is stationary and the gas pressure cylinder travels outwards, thereby drawing the push tube down with it. Instead of a pneumatic spring one may also use a mechanical spring which, for example, is attached right at the bottom of the upright tube, and whose other end is attached to the push tube. The important thing to ensure is that this mechanical spring develops an approximately consistent force over the entire path to be travelled by the push tube. If necessary, the spring can be tensioned along the whole length of the shade, i.e. from the very bottom inside the upright tube right to the tip of the shade, i.e. to the end crown.

The roof awning is tensioned manually. An articulated lever mechanism as shown in FIGS. 5 and 6 is provided for this purpose. When the shade opens, runner crown 5 moves upwards; to tension the roof awning resp. the shade cloth, this runner crown 5 then has to be moved a few centimetres further up. Attached to runner crown 5 there is a lever 15 for this purpose, which, seen from upright tube 1, is angled slightly outwards. Crown 5 is depicted underneath this Figure, seen from above. The end of lever 15 is fitted with a spherical grip 16. Joined to the end of the straight part of the lever 15 extending from runner crown 5 there is an articulated lever 17, which is tensioned by means of a spring 18 so that it is always kept in the angled position shown here. At the end of this articulated lever 17 there is a cam 19, which engages in a number of holes 20 contrived in a vertical row along upright tube 1. The drawing only shows one such hole 20. Once the pneumatic or mechanical spring has almost fully opened the shade, one grips lever 15 and introduces articulated lever 17 with its cam 19 into a suitable hole 20 and one then presses lever 15 towards upright tube 1, whereupon the lever action of articulated lever 17 causes runner crown 5 to move upwards above lever 15, which is joined to it, until the straight part of lever 15 abuts against upright tube 1. In this position a pin can be inserted into hole 21 in lever 15, which also passes through a corresponding hole 22 in the extension 23 of runner crown 5. With this operation complete, lever 15 is secured in this position and the roof awning is tensioned, as shown in FIG. 6. If one wishes to tension the awning even more, the articulated lever 17 on lever 15 simply has to be introduced into a hole 20 higher up upright tube 1 and secured.

What is claimed is:

1. An upright shades, comprising: an upright tube, a shade structure made up of roof struts which are joined to a mobile end crown (4) disposed at a top end of a push tube, said push tube being longitudinally displaceable inside said upright tube; supporting struts connected at their top ends to said roof struts for providing support, and at their bottom ends to a runner crown displaceable along said upright tube; and auxiliary struts for coordinating opening and closing movements of said roof struts and said supporting struts, said auxiliary struts being articulated and arranged between a stationary crown disposed at the top end of said upright tube, and said supporting struts, in which a steel or pneumatic spring is fitted inside said upright tube for, at least a partial automatic opening and closing of said upright shade in that said end crown is, at least, partially automatically movable by displacing one of said roof struts into its lowest position, thereby opening said upright shade, or into its uppermost position, thereby closing said upright shade.

2. The upright shade according to claim 1, further comprising a gas pressure spring fitted inside said upright tube so that its cylinder is securely connected to said upright tube, and an end of a piston rod is securely connected to said push tube so that by manually initiating the opening movement of said roof struts an extension of said piston rod, under the effect of the pneumatic spring, moves said push tube, with the end crown mounted on its end, downwards towards its lowest position, thereby opening said upright shade.

3. The upright shade according to claim 1, further comprising a gas pressure spring fitted inside said upright tube so that an end of a piston rod is securely connected to said upright tube, and an end of its cylinder is securely connected to said push tube so that by manually initiating the opening movement of roof struts an extension of said piston rod, under the effect of the pneumatic spring, moves said push tube with the end crown mounted on its end, downwards towards its lowest position, thereby opening said upright shade.

4. The upright shade according to claim 1, further comprising a mechanical helical spring fitted inside said upright tube so that one of its ends is securely connected to said upright tube and its other end is securely connected to said push tube so that by manually initiating the opening movement of said roof struts, said helical spring moves said push tube with the end crown mounted on its end, downwards towards its lowest position, thereby opening said upright shade.

5. The upright shade according to claim 1, further comprising a lever joined to said runner crown, said lever having an articulated lever with a cam engageable in a hole in a vertical arrangement of holes on said upright tube, whereupon said lever is movable towards said upright tube and then securable in this end position, thereby pushing said runner crown upwards and opening outwardly said upright shade awning.

* * * * *